US006404145B1

(12) United States Patent
Saito

(10) Patent No.: US 6,404,145 B1
(45) Date of Patent: Jun. 11, 2002

(54) APPARATUS FOR AND METHOD OF CONTROLLING BACKLIGHT FOR LIQUID CRYSTAL DISPLAY

(75) Inventor: Kenji Saito, Asaka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/545,007

(22) Filed: Apr. 6, 2000

(30) Foreign Application Priority Data

Apr. 6, 1999 (JP) ..... 11-098292

(51) Int. Cl.[7] ..... H05B 41/36
(52) U.S. Cl. ..... 315/307; 315/169.1; 345/102
(58) Field of Search ..... 315/308, 307, 315/291, 169.3, 169.4, 169.1; 345/63, 84, 87, 102; 455/574, 572, 550

(56) References Cited

U.S. PATENT DOCUMENTS 5,078,476 A * 1/1992 Shin ..... 345/102
5,812,149 A * 9/1998 Kawasaki et al. ..... 345/98
5,954,820 A * 9/1999 Hetzler ..... 713/323
6,111,559 A * 8/2000 Motomura et al. ..... 345/102
6,119,023 A * 9/2000 Tomiyori ..... 455/574
6,157,143 A * 12/2000 Bigio et al. ..... 315/307

* cited by examiner

*Primary Examiner*—Haissa Philogene
*Assistant Examiner*—Ephrem Alemu

(57) ABSTRACT

An LCD operates with power saved. An image represented by a video signal is displayed on an LCD panel. A backlight lamp emits light onto a rear surface of the LCD panel. The backlight lamp is kept off during a synchronization period of a synchronizing signal. The power consumed by the backlight lamp is saved.

5 Claims, 3 Drawing Sheets

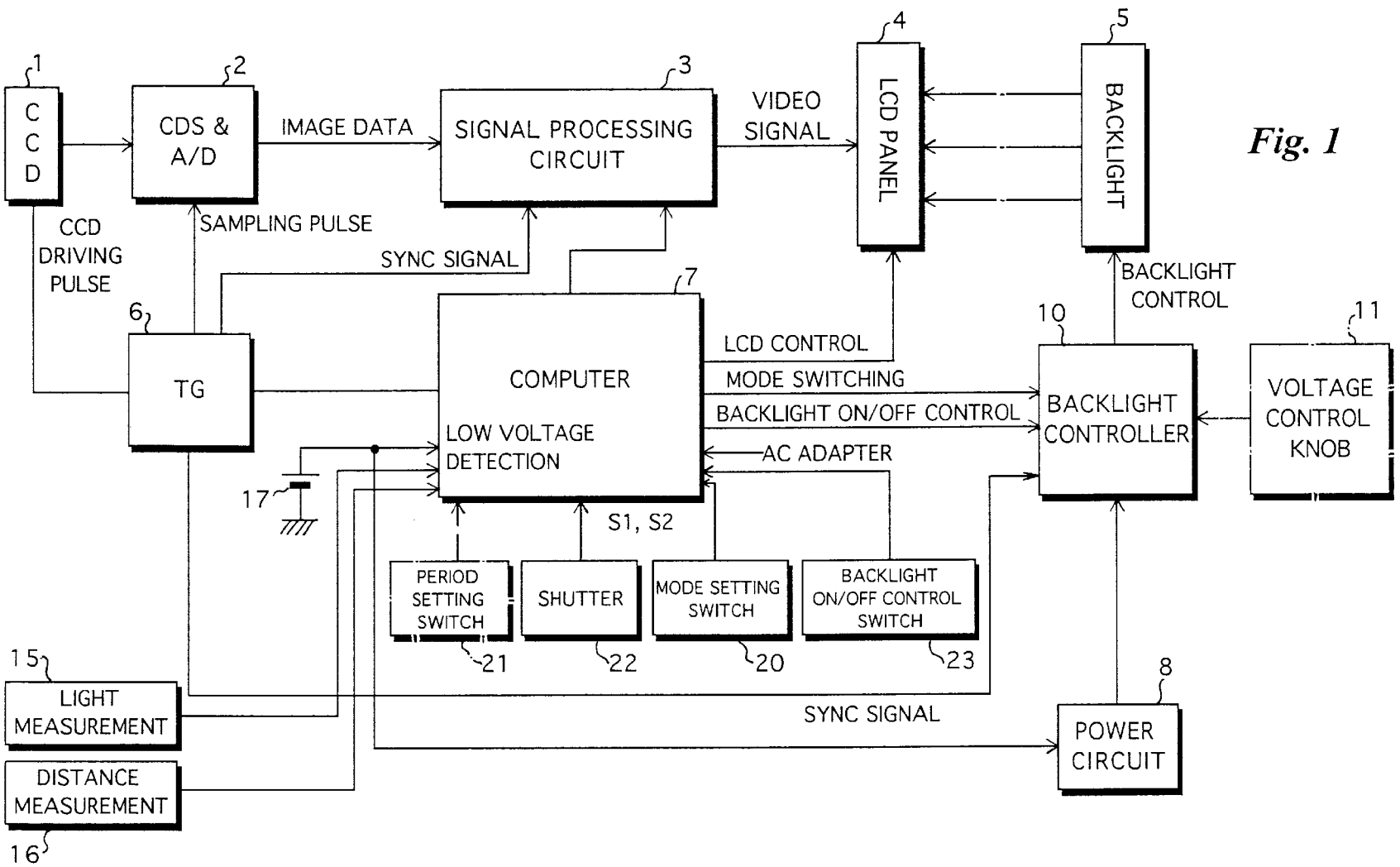
Fig. 1
VOLTAGE CONTROL KNOB
11
BACKLIGHT CONTROL
BACKLIGHT
5
BACKLIGHT CONTROLLER
10
POWER CIRCUIT
8
LCD PANEL
4
VIDEO SIGNAL
LCD CONTROL
MODE SWITCHING
BACKLIGHT ON/OFF CONTROL
AC ADAPTER
BACKLIGHT ON/OFF CONTROL SWITCH
23
SYNC SIGNAL
MODE SETTING SWITCH
20
SIGNAL PROCESSING CIRCUIT
3
COMPUTER
7
LOW VOLTAGE DETECTION
S1, S2
SHUTTER
22
PERIOD SETTING SWITCH
21
SYNC SIGNAL
IMAGE DATA
SAMPLING PULSE
17
CDS & A/D
2
TG
6
CCD DRIVING PULSE
C C D
1
LIGHT MEASUREMENT
15
DISTANCE MEASUREMENT
16

APPARATUS FOR AND METHOD OF CONTROLLING BACKLIGHT FOR LIQUID CRYSTAL DISPLAY

BACKGROUND OF THE INVENTION

1. Field of the Invention

The present invention relates to an apparatus for and a method of controlling backlight for a liquid crystal display (LCD) device in which an image represented by video signals given thereto is displayed at timing synchronized with a synchronizing signal.

2. Description of Related Art

The liquid crystal display device is used for various portable instruments, e.g., a digital still camera and a movie video camera. Since such portable instruments are powered by a battery or the like, it is particularly required to save electric power consumed by the instruments.

The liquid crystal display device includes a liquid crystal display panel having a backlight device (lamp) such as a fluorescent lamp or light emitting diodes (LEDs) on a rear side thereof. The backlight device emits light onto a rear surface of the liquid crystal display panel to illuminate. In a liquid crystal display panel having a backlight device, most power is consumed by the backlight device.

SUMMARY OF THE INVENTION

It is therefore an object of the present invention to provide a backlight control apparatus for use with a liquid crystal display device to save power consumed by the display.

A backlight control apparatus for use with a liquid crystal display device according to the present invention comprises a liquid crystal display panel for displaying, at timing synchronized with a synchronizing signal, an image represented by a video signal supplied thereto; a backlight device for emitting light according to a voltage applied thereto to illuminate the liquid crystal panel from the rear, and voltage controller (control means) for controlling, during a synchronization period of the synchronizing signal, the voltage applied to the backlight device, the voltage being lower during the synchronization period than during a period other than the synchronization period.

In accordance with the present invention, there is also provided a method suitable for the backlight control apparatus above. The backlight control method for use with a liquid crystal display panel in which an image represented by a video signal supplied thereto is displayed at timing synchronized with a synchronizing signal, comprising the steps of: illuminating the liquid crystal display panel from the rear by a backlight device for emitting light according to a voltage applied thereto; and lowering the voltage during a synchronization period of the synchronizing signal, the voltage being lower during the synchronization period than during a period other than the synchronization period.

In accordance with the present invention, during the period of synchronization of the synchronizing signal (the synchronization period does not necessarily mean all the synchronization periods but include one per a plurality of synchronization periods), the voltage applied to the backlight device is lower (inclusive of zero volt) than that applied thereto during a period other than the synchronization period. Since the voltage applied is decreased during the synchronization period, the power consumed by the backlight device is lowered. This consequently saves the power consumed by the liquid crystal display device.

The synchronization period generally means so called a blanking period. The period other than the synchronization period generally means a period in which a video signal for display appears and may be called a "video signal period" or a "display period".

The synchronization period of the synchronizing signal in which the voltage applied to the backlight device is kept reduced may be a horizontal synchronization (blanking) period of a horizontal synchronization signal or a vertical synchronization (blanking) period of a vertical synchronization signal. Moreover, it is not necessarily required that the synchronization period of the lower voltage strictly matches a synchronization period. The synchronization period of the lower voltage may be slightly wider or narrower than the synchronization period. To lower the voltage applied to the backlight device, it is also possible, in addition to simply decrease the voltage, to set the value thereof to zero volt.

The voltage applied to the backlight device may be controlled such that the voltage is reduced once in a plurality of synchronization periods such that the voltage in the period is lower than that in the periods other than the synchronization period.

When the voltage applied to the backlight device is decreased for every synchronization period, an image displayed on the liquid crystal display panel may flicker in some cases. However, the flicker can be suppressed by appropriately controlling the voltage applied to the backlight device, i.e., the lowering degree of the voltage.

It is also possible to dispose a voltage setting device to set the voltage lowering ratio or lowered voltage. The voltage applied to the backlight device in the synchronization period is determined according to a value (ratio or voltage) set by the voltage setting device.

The user may set a voltage lowering ratio of a voltage applied to the liquid crystal panel or the voltage as desired.

The backlight control apparatus may further comprises a power source low voltage detector to detect an event that the power source voltage becomes equal to or less than a predetermined threshold value and a voltage control unit (means) to cause the voltage controller to control the voltage applied to the backlight device during the synchronization period in response to the detection of the low voltage event by the detector.

When the power source voltage is decreased, that is, when the voltage control for power saving is actually required, the voltage applied to the backlight device is controlled. This advantageously saves the power consumption.

When the liquid crystal display panel operates according to power from an alternating current (ac) power source, it is not required to consider the power consumption in most cases. Therefore, the voltage applied to the backlight device need not be lowered even in the synchronization period above.

That is, the backlight control apparatus is further provided with an AC adapter connection (or mount) detector for detecting that the AC adapter which convert an ac voltage (power) to a direct current (dc) voltage (power) of a predetermined value has been connected (mounted). The voltage controller caused to be inactive or disable when the AC adapter connection is detected by the detector so that the control of voltage applied to the backlight device during the synchronization period ceases or is stopped.

Assume that the backlight control apparatus of the present invention is applied to a camera, especially an electronic still camera. To adjust an angle of view, it is necessary for the user to clearly identify or recognize an image displayed on the liquid crystal panel, and hence the voltage lowering control is temporarily stopped to prevent the flickering of the displayed image. For example, when at least a focusing operation (control) or an automatic exposure adjusting operation (control) is carried out in response to a first-step depression of a shutter release button, the voltage lowering operation (control) in the synchronization period is inhibited until an event of the first-step depression is detected. In response to the detection of the first-step depression of the shutter release button, focusing control, exposure control or the like is executed. In this situation, the user need not to clearly identify the image displayed on the display panel, and hence the voltage applied to the backlight device is lowered during the synchronization period, that is the voltage controller becomes active in response to the detection of the first-step depression of the shutter release button.

BRIEF DESCRIPTION OF THE DRAWINGS

The objects and features of the present invention will become more apparent from the consideration of the following detailed description taken in conjunction with the accompanying drawings in which:

FIG. 1 is block diagram showing an electric configuration of a digital still camera;

DESCRIPTION OF THE PREFERRED EMBODIMENTS

Figure 2:
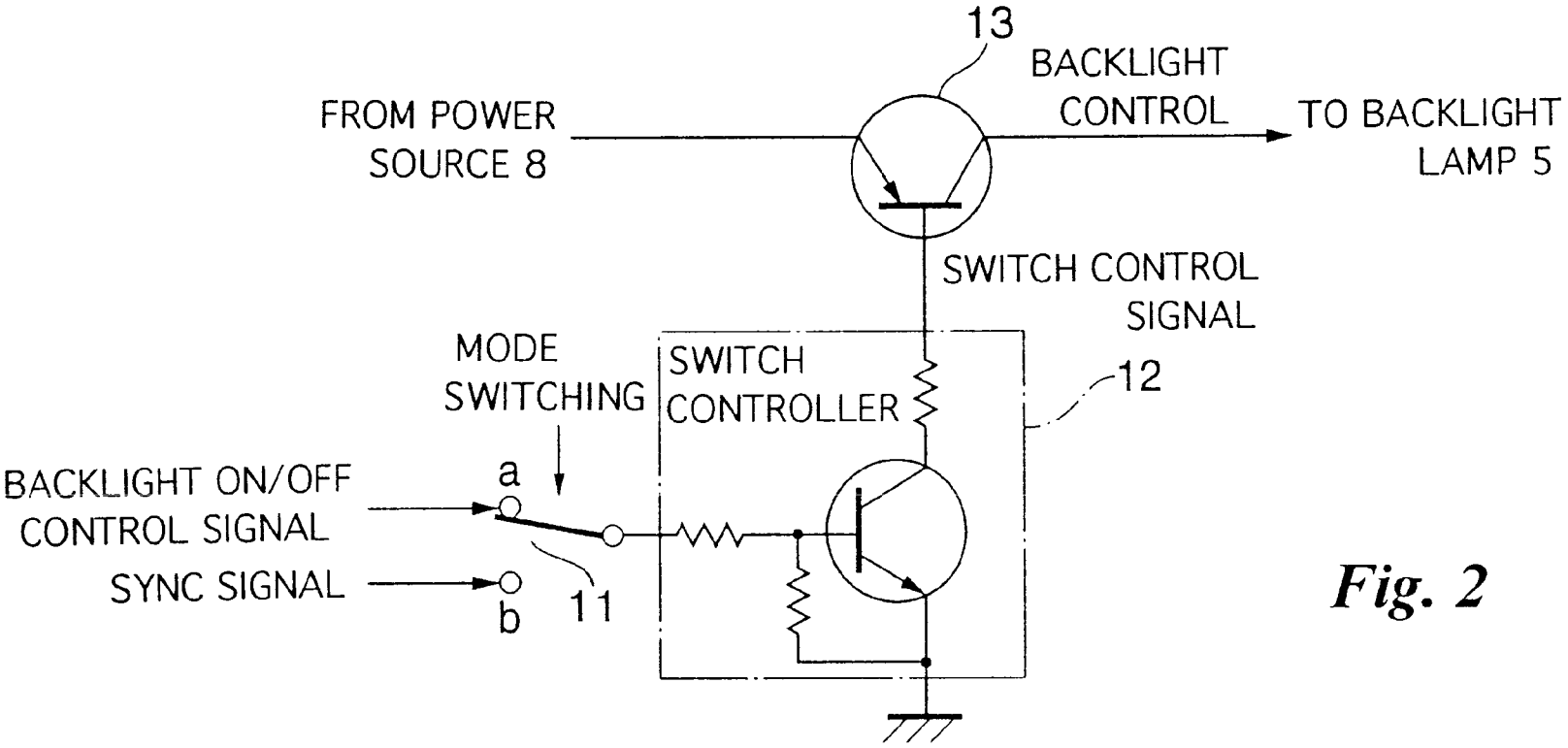
FIG. 2 is a diagram showing a circuit diagram of a backlight control unit.
Figure 3:
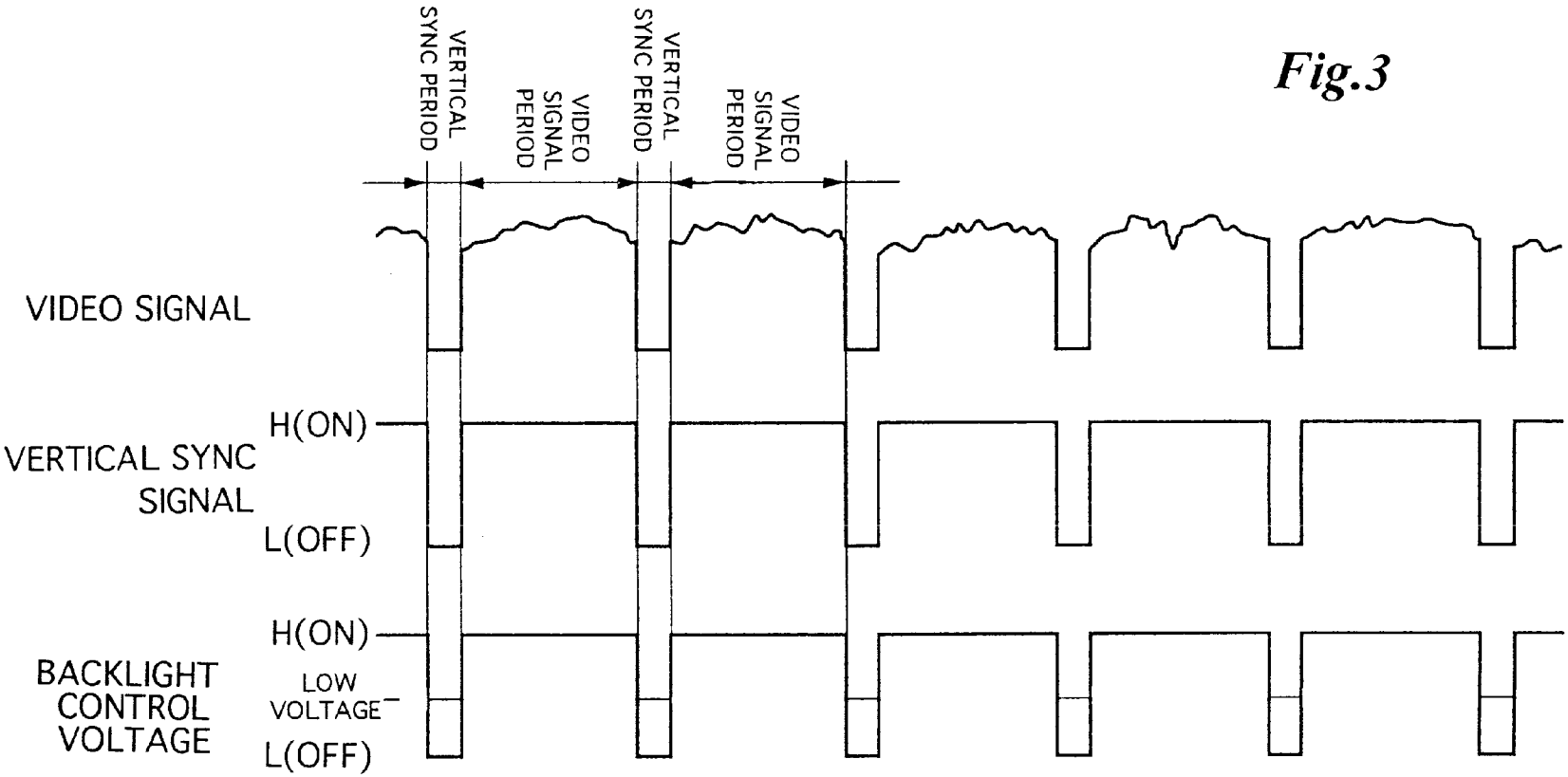
FIG. 3 is a signal timing chart showing signals flowing through circuits in a digital still camera.

FIG. 1 shows in a block diagram an embodiment of the present invention, specifically, an electric configuration of a digital still camera. FIG. 2 shows a circuit configuration of a backlight control apparatus and FIG. 3 is a signal timing chart of signals flowing through the circuits of FIGS. 1 and 2.

Operation of the digital still camera is supervised by a computer (microprocessor) 7.

The camera includes a shutter release button 22 having a first depression step and a second depression step. Operations of the first and second depression steps are respectively indicated by signals S1 and S2, which are delivered to the computer 7.

The digital still camera includes a light measuring circuit 15 and a distance measuring circuit 16. The circuit 15 measures brightness of an object to be shot by the camera. A value thus measured is represented by a signal. The signal is fed from the circuit 15 to the computer 7. A distance from the camera to the object is measured by the circuit 16, and a signal indicating the distance is fed to the computer 7. When the signal S1 indicating first-step depression of shutter release button 22 is inputted to the computer 7, the brightness signal outputted from the circuit 15 and the distance signal outputted from the circuit 16 are fetched into the computer 7. According to the measured values respectively of the brightness and distance, the computer 7 determines a shutter speed and controls a focusing operation.

The digital still camera includes a mode setting switch 20. This camera has a power saving mode in which power consumed by a backlight lamp is lowered (of course, the backlight lamp is kept in on-state), and a forced control mode in which the backlight lamp is forcibly turned on or off, which will be described later. The switch 20 is used to set either one of these modes. A signal indicating the mode set by the switch 20 is delivered to the computer 7.

The camera includes a backlight on/off control switch 23, which is operated by a user, to turn backlight lamp 5 on or off in the forced control mode. A signal indicating that the switch 23 has been set to the forced on or off state of the backlight lamp 5 is fed to the computer 7. The backlight lamp is realized by a fluorescent lamp, an LED (Light Emitting Diode) or the other light source.

In the camera, there is accommodated a battery 17 attachablly and detachablly as a main power source. The battery 17 provides a voltage to the computer 7. The computer 7 checks the voltage of the battery 17 to detect a voltage drop. The voltage is also applied to a power source circuit 8. The circuit 8 supplies operating power to respective circuits of the digital still camera.

The camera includes a timing generator 6. The generator 6 generates various signals and pulses such as a synchronizing signal, a charge coupled device (CCD) driving pulse, and a sampling pulse. The CCD driving pulse from the generator 6 is inputted to a CCD 1, and the sampling pulse is fed to a correlated double sampling (CDS) and analog-to-digital (A/D) converting circuit 2. The synchronizing signal is inputted to a signal processing circuit 3 and a backlight control circuit 10. The synchronizing signal is, in this embodiment, kept at a low (L) level during a substantial blanking period (a synchronization period) and kept at a high (H) level during a period in which a video signal appears (a video signal period). A vertical scanning period (1V) equals to the sum of the synchronization period and the video signal period.

An object is imaged by the CCD 1 operating in response to the CCD driving pulse. As a result, there is produced a video signal representing the image. The video signal from the CCD 1 is fed to the circuit 2 and is processed through a correlated double sampling operation according to the sampling pulse supplied from the timing generator 6. Thereafter, the signal is converted into digital image data. The data is delivered to the signal processing circuit 3.

On receiving the signal, the circuit 3 conducts various processings such as a gamma correction, a color balance adjustment, and a digital-to-analog conversion to produce an analog video signal. Synchronizing signals including vertical and horizontal synchronizing signals from the timing generator 6 are added to the analog video signal. The video signal with the synchronizing signals is inputted to a LCD (Liquid Crystal Device) panel 4 such that an image of the video signal is displayed thereon at timing synchronized with the synchronizing signals.

In the digital still camera, the backlight lamp 5 is controlled by the backlight controller 10. The backlight lamp 5 emits light onto a rear surface of the LCD panel 4 to help the user easily recognize the image displayed on the LCD panel 4.

The backlight controller 10 receives, in addition to the synchronizing signal from the timing generator 6, a mode switching signal and a backlight on/off control signal from the computer 7 as well as an operating voltage from the power source circuit 8.

Referring primarily to FIG. 2, the controller 10 includes a mode switching unit 11. The unit 11 includes a terminal a to receive the backlight on/off control signal which indicates on or off state set by the switch 23 and a terminal b to receive the synchronizing signal. The switching unit 11 selects the terminal a or b in response to the mode switching signal. When the forced control mode is set by the mode setting switch 20, the terminal a is selected. The backlight on/off control signal set by the user is supplied to a switch control circuit 12 in the subsequent stage. When the switch 20 sets a power saving mode, the terminal b is selected. The signal having passed the switching unit 11 is delivered to the switch control circuit 12.

When the forced control mode is set by the mode setting switch 20, the backlight on/off control signal set by the user is inputted to the circuit 12. Therefore, the circuit 12 produces a switch control signal corresponding to the backlight on/off control signal. When the power saving mode is set by the switch 20, the synchronizing signal is fed to the switch control circuit 12. Consequently, the circuit 12 produces a switch control signal corresponding to the synchronizing signal.

The backlight controller 10 includes a switching transistor 13. An operating voltage is supplied from the power source circuit 8 to an emitter of the transistor 13. The switch control signal from the switch control circuit 12 is fed to a base of the transistor 13. In response to a switch control signal from the circuit 12, the transistor 13 turns on or off such that an operating voltage is applied from the power source circuit 8 to the backlight lamp 5.

Specifically, when a backlight on/off control signal is supplied in response to the user's operation in the forced control mode, the backlight 5 is forcibly turned on or off in response to the backlight on/off control signal. In the power saving mode, the transistor 13 is on during the (video signal period) in which the vertical synchronizing signal is at a high (H) level, and hence an operating voltage is delivered from the power source circuit 8 to the backlight lamp 5. Since the transistor 13 is off during the synchronization period in which the vertical synchronizing signal is at a low (L) level, the operating voltage is not supplied from the power source circuit 8 to the backlight lamp 5. In the power saving mode, the power consumed by the backlight lamp 5 can be suppressed during the period in which the vertical synchronizing signal is at the low level. Consequently, the power consumed by the digital still camera can be reduced.

Although the backlight lamp 5 is off during the vertical synchronization period in this embodiment, it may also be possible that the backlight lamp 5 is off during the horizontal synchronization period of the horizontal synchronizing signal. This is especially effective in a case where the backlight lamp 5 is realized by a high speed response element or a semiconductor light emitting device such as an LED.

The digital still camera may include a voltage control knob (a volume on a variable register) 11. A signal representing a state of setting of the knob 11 is fed to the backlight controller 10. During the synchronization period (or a period slightly longer or shorter than the synchronization period) in the power saving mode, the backlight lamp 5 is not turned off, but the voltage applied to the backlight lamp 5 is decreased according to the setting of the knob 11 to a value (of a low voltage of FIG. 3) less than the voltage applied thereto during the video signal period. This also decreases the power consumed by the backlight lamp 5. In this situation, a DC-DC converter is favorably disposed in the backlight controller 10 to lower a voltage. Alternatively the output voltage of the power circuit 8 is directly divided by the variable register (the voltage control knob). The voltage applied to the backlight lamp 5 is changed over from the output of the power circuit 8 to the output of the DC-DC converter or of the variable register or vice-versa by a change-over switch controlled by the synchronizing signal.

The camera may include a period setting switch 21. The switch 21 is used to turn the backlight lamp 5 off only once per a plurality of synchronization periods. When the backlight lamp 5 is turned off for each synchronization period, the image displayed on the LCD panel 4 conspicuously flickers in some cases. When the backlight lamp 5 is turned off only once per a plurality of synchronization periods, the flicker in the image on the LCD panel 4 is not perceived by the user and the power consumption is advantageously reduced.

It may also be possible that until the shutter release button 22 is depressed up to the first step, the operation to turn the backlight lamp 5 off during the synchronization period is suppressed even in the power saving mode. Only when the shutter release button 22 is depressed up to the first step, the power saving mode becomes valid. In many cases, until the shutter release button 22 is depressed up to the first step, the user is trying to decide the angle of view of an object, i.e., the user is watching the image on the LCD panel 4. In consequence, until the user completely decides the angle of view of an object (until the button 22 is depressed up to the first step), the operation to turn the backlight lamp 5 off during the synchronization period is suppressed to prevent the flicker of the image on the LCD panel 4. When the button 22 is depressed up to the second step, the angle of view has already been decided and the user little pays attention to the image on the LCD panel 4 in most cases. Consequently, in the situation above, the camera is set to the power saving mode to minimize the power consumption.

It is also possible that the camera is set to the power saving mode at detection of an event that the voltage of the battery 17 is decreased. Until when the computer 7 detects the low voltage of the battery 17, an H-level signal is fed, in place of the synchronizing signal, to the backlight controller 10 to keep the transistor 13 of the controller 10 on.

Moreover, the computer 7 may have a function to detect whether or not an AC adapter has been attached to the digital still camera. When the camera operates according to power from the AC adapter, the power consumption may not be taken into consideration in most cases as compared with the case operating with the battery 17. Therefore, the power saving mode is suppressed also when the AC adapter is attached to the digital still camera.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A backlight control apparatus for use with a liquid crystal display device, comprising:

a liquid crystal display panel included in the liquid crystal display device for displaying, at timing synchronized with a synchronizing signal, an image represented by a video signal supplied thereto;

a backlight device for emitting light according to a voltage applied thereto to illuminate the liquid crystal panel from the rear; and a voltage controller controlling, during a synchronization period of the synchronizing signal, the voltage applied to the backlight device, the voltage being lower during the synchronization period than during a period other than the synchronization period.

2. A backlight control apparatus for use with a liquid crystal display device in accordance with claim 1, wherein the voltage controller controls, once per a plurality of synchronization periods of the synchronizing signal, the voltage applied to the backlight device, the voltage being lower during the synchronization period than during a period other than the synchronization period.

3. A backlight control apparatus for use with a liquid crystal display device in accordance with claim 1, further including a voltage setting device for setting a ratio for the reduction of the voltage or a low voltage, wherein the voltage controller determines the voltage applied to the backlight device during the synchronization period according to a setting in the voltage setting means.

4. A backlight control apparatus for use with a liquid crystal display device in accordance with claim 1, further including:

a power source voltage drop detecting device for detecting an event that the voltage of the power source is lowered to a value equal to or less than a predetermined threshold value; and means for causing the voltage controller to control the voltage applied to the backlight device during the synchronization period in response a detection of the event of a power source voltage drop detected by the power source voltage drop detecting device.

5. A backlight control method for use with a liquid crystal display panel in which an image represented by a video signal supplied thereto is displayed at timing synchronized with a synchronizing signal, comprising the steps of:

illuminating the liquid crystal display panel from the rear by a backlight device for emitting light according to a voltage applied thereto; and lowering the voltage during a synchronization period of the synchronizing signal, the voltage being lower during the synchronization period than during a period other than the synchronization period.

* * * * *